US007325621B2

(12) United States Patent
Naquin, Sr. et al.

(10) Patent No.: US 7,325,621 B2
(45) Date of Patent: Feb. 5, 2008

(54) METHOD AND APPARATUS FOR ECP ELEMENT INFLATION UTILIZING SOLID LADEN FLUID MIXTURE

(75) Inventors: Michael J. Naquin, Sr., Kingwood, TX (US); Edward T. Wood, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/513,546

(22) Filed: Aug. 31, 2006

(65) Prior Publication Data

US 2006/0289161 A1 Dec. 28, 2006

Related U.S. Application Data

(63) Continuation of application No. 10/763,863, filed on Jan. 22, 2004, now Pat. No. 7,178,603.

(60) Provisional application No. 60/443,404, filed on Jan. 29, 2003.

(51) Int. Cl.
*E21B 33/127* (2006.01)

(52) U.S. Cl. ..... 166/387; 166/126; 166/148; 166/187; 277/333

(58) Field of Classification Search ..... 166/381, 166/387, 118, 120, 122, 126, 142, 148, 187, 166/278; 277/322, 331, 333, 334, 336
See application file for complete search history.

(56) References Cited

U.S. PATENT DOCUMENTS

| | | | | | |
|---|---|---|---|---|---|
| 1,944,442 | A * | 1/1934 | Manning | 166/147 |
| 2,581,070 | A * | 1/1952 | Blood | 166/100 |
| 2,618,344 | A * | 11/1952 | Turechek et al. | 166/63 |
| 2,922,478 | A | 1/1960 | Maly | 166/154 |
| 3,085,628 | A * | 4/1963 | Malone | 277/333 |
| 3,866,681 | A | 2/1975 | Shirley | 166/285 |
| RE30,711 | E * | 8/1981 | Suman, Jr. | 166/285 |
| 4,378,843 | A * | 4/1983 | Suman, Jr. | 166/278 |
| 4,484,626 | A | 11/1984 | Kerfoot et al. | 166/191 |
| 5,186,258 | A * | 2/1993 | Wood et al. | 166/387 |
| 5,271,469 | A * | 12/1993 | Brooks et al. | 166/387 |
| 5,417,285 | A | 5/1995 | Van Buskirk et al. | 166/292 |
| 5,476,143 | A * | 12/1995 | Sparlin et al. | 166/233 |
| 6,009,951 | A * | 1/2000 | Coronado et al. | 166/387 |
| 6,508,305 | B1 * | 1/2003 | Brannon et al. | 166/293 |
| 6,575,251 | B2 * | 6/2003 | Watson et al. | 166/387 |
| 2002/0189821 | A1 | 12/2002 | Watson et al. | 166/387 |
| 2004/0020644 | A1 * | 2/2004 | Wilson et al. | 166/250.01 |
| 2005/0023003 | A1 * | 2/2005 | Echols et al. | 166/384 |

FOREIGN PATENT DOCUMENTS

WO PCT/NO01/00175 4/2001

* cited by examiner

*Primary Examiner*—David Bagnell
*Assistant Examiner*—David Andrews
(74) *Attorney, Agent, or Firm*—Cantor Colburn LLP

(57) ABSTRACT

An inflatable element utilizing a solid or particulate laden fluid as an expansion media. A fluid component of the solid or particulate laden fluid is exhausted from a defined area of the element to leave substantially only particulate matter therein to maintain the expanded state of the seal. A method for sealing includes pumping a solid laden or a particulate laden fluid to an expandable, pressurized element. A fluid component of the solid or particulate laden fluid is removed from the expandable element with substantially solid material comprised to maintain the expanded element in the expanded condition.

19 Claims, 4 Drawing Sheets

METHOD AND APPARATUS FOR ECP ELEMENT INFLATION UTILIZING SOLID LADEN FLUID MIXTURE

CROSS REFERENCE TO RELATED APPLICATIONS

This application claims the benefit of an earlier filing date from U.S. Ser. No. 10/763,863, filed Jan. 22, 2004, now U.S. Pat. No. 7,178,603 which itself claims an earlier filing date from U.S. Provisional Application Ser. No. 60/443,404 filed Jan. 29, 2003, the entire contents of both of which are incorporated herein by reference.

BACKGROUND

During hydrocarbon exploration and production numerous different types of equipment is employed in the downhole environment. Often the particular formation or operation and parameters of the wellbore requires isolation of one or more sections of a wellbore. This is generally done with expandable tubular devices including packers which are either mechanically expanded or fluidically expanded. Fluidically expanded sealing members such as packers are known as inflatables. Traditionally, inflatables are filled with fluids that remain fluid or fluids that are chemically converted to solids such as cement or epoxy. Fluid filled inflatables although popular and effective can suffer the drawback of becoming ineffective in the event of even a small puncture or tear. Inflatables employing fluids chemically convertible to solids are also effective and popular, however, suffer the drawback that in an event of a spill significant damage can be done to the well since indeed the chemical reaction will take place, and the fluid substance will become solid regardless of where it lands. In addition, under certain circumstances during the chemical reaction between a fluid and a solid the converting material actually loses bulk volume. This must be taken into account and corrected or the inflatable element may not have sufficient pressure against the well casing or open hole formation to effectively create an annular seal. If the annular seal is not created, the inflatable element is not effective.

SUMMARY

Disclosed herein is an expandable element which includes a base pipe, a screen disposed at the base pipe and an expandable material disposed radially outwardly of the base pipe and the screen.

Further disclosed herein is an annular seal system wherein the system uses a particle laden fluid and pump for this fluid. The system pumps the fluid into an expandable element.

Further disclosed herein is a method of creating a wellbore seal which includes pumping a solid laden fluid to an expandable element to pressurize and expand that element. Dehydrating the solid laden fluid to leave substantially a solid constituent of the solid laden fluid in the expandable element.

Further disclosed herein is an expandable element that includes an expandable material which is permeable to a fluid constituent of a solid laden fluid delivered thereto while being impermeable to a solid constituent of the solid laden fluid.

BRIEF DESCRIPTION OF THE DRAWINGS

Referring now to the drawings wherein like elements are numbered alike in the several figures.

DETAILED DESCRIPTION

In order to avoid the drawbacks of the prior art, it is disclosed herein that an inflatable or expandable element may be expanded and maintained in an expanded condition thereby creating a positive seal by employing a slurry of a fluidic material entraining particulate matter and employing the slurry to inflate/expand an element. The fluidic material component of the slurry would then be exhausted from the slurry leaving only particulate matter within the element. This can be done in such a way that the element is maintained in a seal configuration by grain-to-grain contact between the particles and areas bounded by material not permeable to the particulate matter. A large amount of pressure can be exerted against the borehole wall whether it be casing or open hole. As desired, pressure exerted may be such as to elastically or even plastically expand the borehole in which the device is installed. A plurality of embodiments are schematically illustrated by the above-identified drawings which are referenced hereunder.

Figure 1:
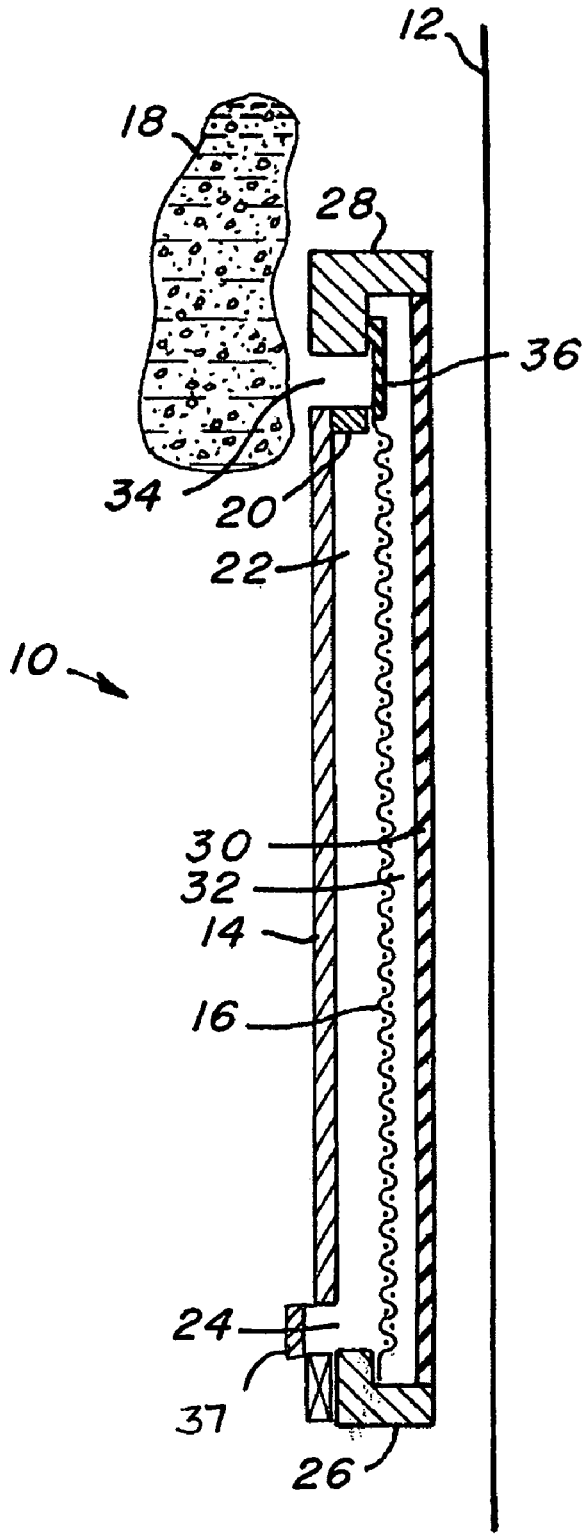
FIG. 1 is a schematic quarter section view of an inflatable element.
Figure 4:
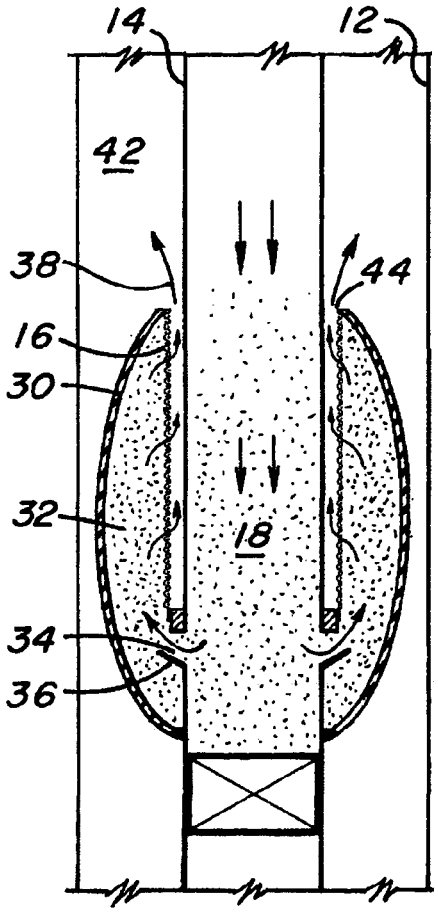
FIG. 4 is a schematic illustration of another embodiment where fluid is exited into the annulus of the wellbore.

Referring to FIG. 1, the expandable device 10 is illustrated schematically within a wellbore 12. It is important to note that the drawing is schematic and as depicted, this device is not connected to any other device by tubing or otherwise although in practice it would be connected to other tubing on at least one end thereof. The device includes a base pipe 14 on which is mounted a screen 16 spaced from the base pipe by an amount sufficient to facilitate the drainoff of a fluidic component of the slurry. A ring 20 is mounted to base pipe 14 to space screen 16 from base pipe 14 and to prevent ingress and egress of fluid to space 22 but for through screen 16. For purposes of explanation this is illustrated at the uphole end of the depicted configuration but could exist on the downhole end thereof or could be between the uphole and downhole end if particular conditions dictated but this would require drain off in two directions and would be more complex. An exit passage 24 is also provided through base pipe 14 for the exit of fluidic material that is drained off through screen 16 toward base pipe 14. In this embodiment, the fluid exit passage is at the downhole end of the tool. The fluid exit passage 24 could be located anywhere along base pipe 14 but may provide better packing of the downhole end of the device if it is positioned as illustrated in this embodiment. At the downhole end of screen 16 the screen is connected to end means 26. Downhole end means 26 and uphole end means 28 support the expandable element 30 as illustrated. As can be ascertained from drawing FIG. 1, a defined area 32 is provided between screen 16 and element 30. The defined area 32 is provided with an entrance passageway 34 and a check valve 36 through which slurry may enter the defined area 32. The defined area 32 to may also optionally include an exit passage check valve 37. FIG. 4 is an alternate embodiment where the fluidic substance 38 of slurry 18 is not dumped to the I.D. of the base pipe 14, but rather is dumped to the annulus 42 of the borehole 12. The escape passage 44 is illustrated at the uphole end of the device however could be at the downhole end of the device as well. Other components are as they were discussed in FIG. 1.

The slurry comprises a fluidic component comprising one or more fluid types and a particulate component comprising one or more particulate types. Particulates may include gravel, sand, beads, grit, etc. and the fluidic components may include water, drilling mud, or other fluidic substances or any other solid that may be entrained with a fluid to be transported downhole. It will be understood by those of skill in the art that the density of the particulate material versus the fluid carrying the particulate may be adjusted for different conditions such as whether the wellbore is horizontal or vertical. If a horizontal bore is to be sealed it is beneficial that the density of the particulate be less than that of the fluid and in a vertical well that the density of the particulate be more than the fluid. The specific densities of these materials may be adjusted anywhere in between the examples given as well.

In one embodiment the particulate material is coated with a material that causes bonding between the particles. The bonding may occur over time, temperature, pressure, exposure to other chemicals or combinations of parameters including at least one of the foregoing. In one example the particulate material is a resin or epoxy coated sand commercially available under the tradename SUPERSAND.

Figure 2:
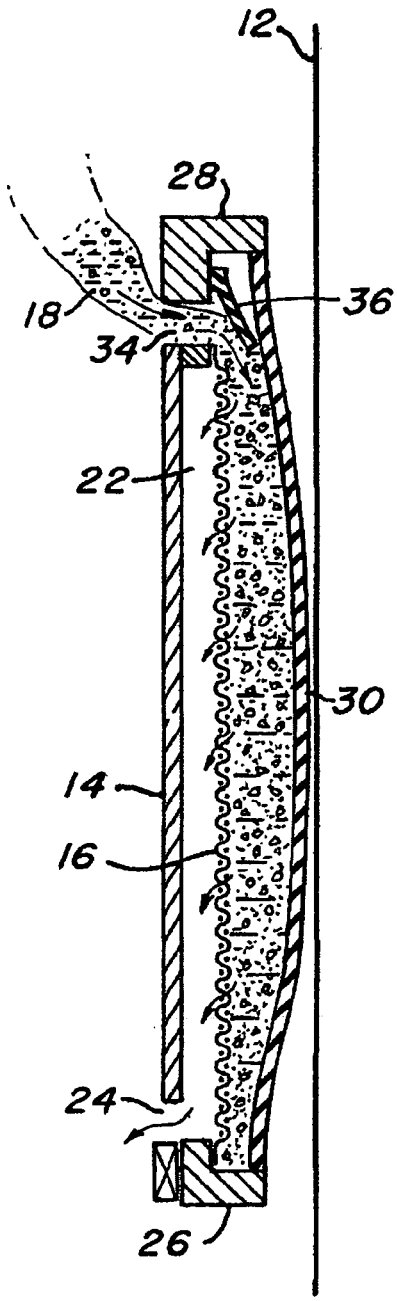
FIG. 2 is a schematic illustration of a device of FIG. 1 partially inflated.
Figure 3:
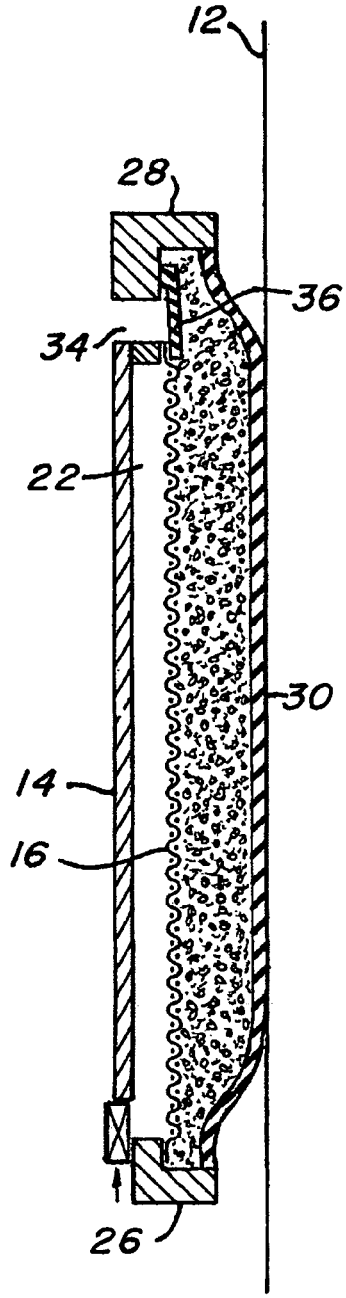
FIG. 3 is a schematic view of the device of FIG. 1 fully inflated.

Slurry 18 is introducible to the seal device through entrance passageway 34 past check valve 36 into defined area 32 where the slurry will begin to be dehydrated through screen 16. More particularly, screen 16 is configured to prevent through passage of the particulate component of slurry 18 but allow through passage of the fluidic component(s) of slurry 18. As slurry 18 is pumped into defined area 32, the particulate component thereof being left in the defined area 32 begins to expand the expandable element 30 due to pressure caused first by fluid and then by grain-to-grain contact of the particulate matter and packing of that particulate matter due to flow of the slurry. The action just described is illustrated in FIG. 2 wherein one will appreciate the flow of fluidic components through screen 16 while the particulate component is left in the defined area 32 and is in the FIG. 2 illustration, expanding expandable element 30 toward borehole wall 12. Slurry will continue to be pumped until as is illustrated in FIG. 3 there is significant grain-to-grain loading throughout the entirety of defined area 32 of the particulate matter such that the expandable element 30 is urged against borehole wall 12 to create a seal thereagainst. Grain-to-grain loading causes a reliable sealing force against the borehole which does not change with temperature or pressure. In addition, since the slurry employed herein is not a hardening slurry there is very little chance of damage to the wellbore in the event that the slurry is spilled.

Figure 5:
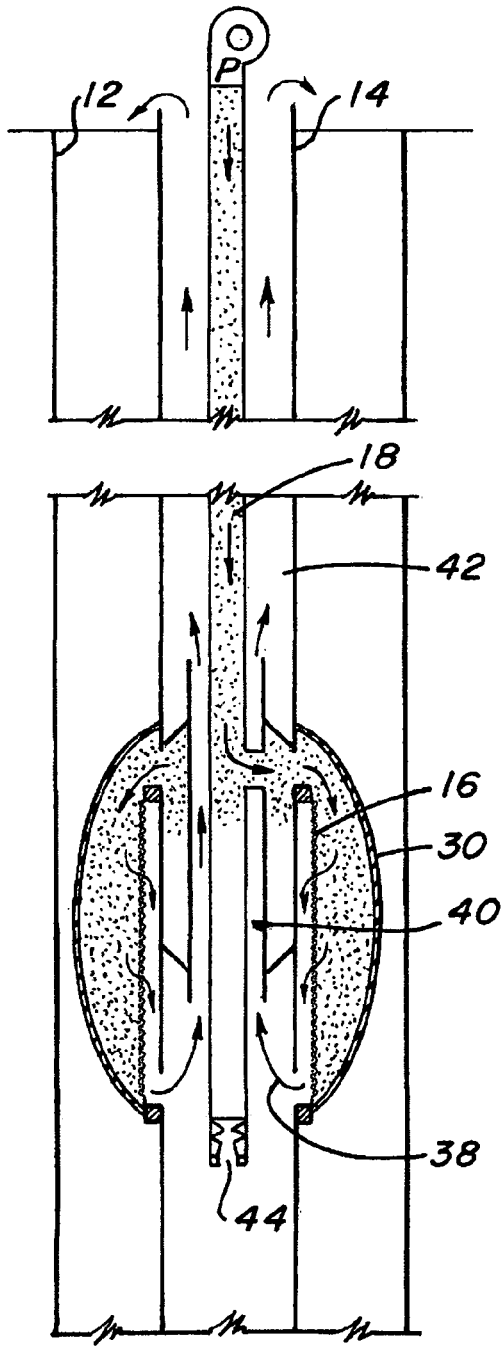
FIG. 5 illustrates a similar device for fluid from a slurry is returned to surface rather than exhausted downhole.
Figure 6:
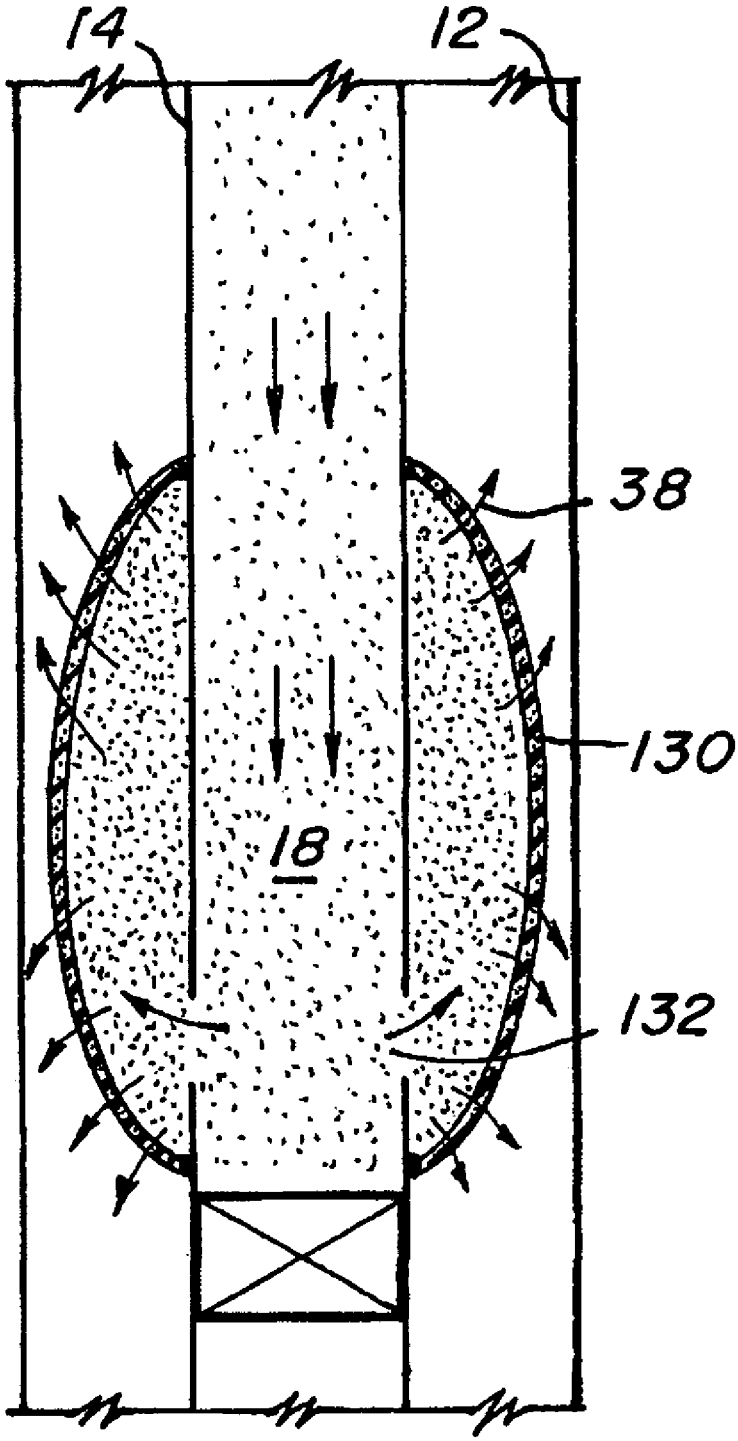
FIG. 6 is a schematic illustration of an embodiment where the inflatable element is permeable to the fluid constituent of the slurry.

In the embodiment just discussed, the exiting fluidic component of the slurry is simply dumped into the tubing downhole of the element and allowed to dissipate into the wellbore. In the embodiment of FIG. 5, (referring thereto) the exiting fluidic component is returned to an uphole location through the annulus in the wellbore created by the tubing string connected to the annular seal. This is schematically illustrated with FIG. 5. Having been exposed to FIGS. 1-3, one of ordinary skill in the art will appreciate the distinction of FIG. 5 and the movement of the fluidic material up through an intermediate annular configuration 40 and out into the well annulus 42 for return to the surface or other remote location. In other respects, the element considered in FIG. 5 is very similar to that considered in FIG. 1 and therefore the numerals utilized to identify components of FIG. 1 are translocated to FIG. 5. The exiting fluid is illustrated as numeral 38 in this embodiment the tubing string is plugged below the annular seal element such as schematically illustrated at 44. Turning now to FIG. 6, an alternate embodiment of the seal device is illustrated which does not require a screen. In this embodiment the element 130 itself is permeable to the fluidic component of the slurry 18. As such, slurry 18 may be pumped down base pipe 14 from a remote location and forced out slurry passageway 132 into element 130. Upon pushing slurry into a space defined by base pipe 14 and element 130, the fluid component(s) of slurry 18 are bled off through element 130 leaving behind the particulate component thereof. Upon sufficient introduction of slurry 18, element 130 will be pressed into borehole wall 12 for an effective seal as is the case in the foregoing embodiments.

In each of the embodiments discussed hereinabove a method to seal a borehole includes introducing the slurry to an element which is expandable, dehydrating that slurry while leaving the particulate matter of the slurry in a defined area radially inwardly of an expandable element, in a manner sufficient to cause the element to expand against a borehole wall and seal thereagainst. The method comprises pumping sufficient slurry into the defined area to cause grain-to-grain loading of the particulate component of the slurry to prevent the movement of the expandable element away from the borehole wall which would otherwise reduce effectiveness of the seal.

It will further be appreciated by those of skill in the art that elements having a controlled varying modulus of elasticity may be employed in each of the embodiments hereof to cause the element to expand from one end to the other, from the center outward, from the ends inward or any other desirable progression of expansion.

While preferred embodiments have been shown and described, modifications and substitutions may be made thereto without departing from the spirit and scope of the invention. Accordingly, it is to be understood that the present invention has been described by way of illustrations and not limitation.

What is claimed is:

1. A seal element comprising:

a base pipe;

a screen disposed at said base pipe positioned such that a fluidic component of a solid laden fluid introducible to said seal element is drainable radially to said base pipe;

an expandable material disposed radially outwardly of and substantially coaxially aligned with said base pipe and said screen; and a fluid exit passage including a check valve positioned to prevent fluid flow into said seal element through said exit passage.

2. The seal element as claimed in claim 1 wherein said expandable material is progressively expandable.

3. The seal element as claimed in claim 1 wherein said expandable material is fluid impermeable.

4. The seal element as claimed in claim 1 wherein said screen is configured to allow passage of a fluid constituent of a slurry while impeding passage of a solid constituent of said slurry.

5. The seal element as claimed in claim 4 wherein said fluid is drained off to said base pipe.

6. The seal element as claimed in claim 4 wherein said fluid is drained off to a wellbore annulus.

7. The seal element as claimed in claim 1 wherein said screen and said expandable element define an area into which a slurry is accepted and a particulate constituent of said slurry is retained.

8. The seal element as claimed in claim 1 wherein said element is maintained in an expanded condition by grain-to-grain contact of a solid constituent of said slurry.

9. The seal element as claimed in claim 1 wherein said element further includes a check valve configured to prevent backflow of a slurry.

10. The seal element as claimed in claim 1 wherein said screen is spaced from said base pipe to facilitate fluid drain off.

11. The seal element as claimed in claim 1 wherein said element includes a slurry entrance passage.

12. The seal element as claimed in claim 11 wherein said entrance passage includes a check valve.

13. A method of creating a wellbore seal comprising:

pumping a solid laden fluid to an expandable element, said solid laden fluid including a particulate material and a fluid said particulate material being less dense than said fluid;

pressurizing said element to expand the same; and dehydrating said solid laden fluid in said expandable element leaving substantially only a solid constituent of said solid laden fluid, said fluid moving radially inwardly and then annularly outside of said base Pipe to an inlet into said base pipe.

14. The method creating a wellbore seal as claimed in claim 13 further comprising causing grain-to-grain loading of said solid constituent.

15. The method of creating a wellbore seal as claimed in claim 13 wherein said dehydrating comprises draining a fluid constituent of said solid laden fluid to a base pipe.

16. The method of creating a wellbore seal as claimed in claim 13 wherein said dehydrating comprises draining a fluid constituent of said solid laden fluid to an annulus.

17. The method of creating a wellbore seal as claimed in claim 13 wherein said dehydrating comprises draining a fluid constituent of said solid laden fluid through said element.

18. The method of creating a wellbore seal as claimed in claim 13 wherein said method includes elastically expanding the wellbore.

19. The method of creating a wellbore seal as claimed in claim 13 wherein said method includes plastically expanding the wellbore.

* * * * *